US005686682A

United States Patent [19]

Ohshima et al.

[11] Patent Number: 5,686,682

[45] Date of Patent: Nov. 11, 1997

[54] ELECTRONIC MUSICAL INSTRUMENT CAPABLE OF ASSIGNING WAVEFORM SAMPLES TO DIVIDED PARTIAL TONE RANGES

[75] Inventors: Osamu Ohshima; Tokiharu Ando, both of Hamamatsu, Japan

[73] Assignee: Yamaha Corporation, Hamamatsu, Japan

[21] Appl. No.: 524,612

[22] Filed: Sep. 7, 1995

[30] Foreign Application Priority Data

Sep. 9, 1994 [JP] Japan ..... 6-242067

[51] Int. Cl.[6] ..... G10H 1/22; G10H 7/02

[52] U.S. Cl. ..... 84/603; 84/604; 84/618; 84/DIG. 2

[58] Field of Search ..... 84/603–607, 618, 84/DIG. 2

[56] References Cited

U.S. PATENT DOCUMENTS 4,213,366 7/1980 Niimi et al. ..... 84/606
4,468,996 9/1984 Deutsch ..... 84/604
4,584,921 4/1986 Wachi .

FOREIGN PATENT DOCUMENTS 62-161197 7/1987 Japan .
6230783 8/1994 Japan .

*Primary Examiner*—Stanley J. Witkowski
*Attorney, Agent, or Firm*—Loeb & Loeb LLP

[57] ABSTRACT

An electronic musical instrument stores a plurality of waveform samples. A predetermined number of waveform samples are selected from the plurality of waveform samples. Pitch information for designating a pitch within a predetermined tone range is generated. In response to instructions for automatic assignment of waveform samples, partial tone ranges equal in number to the predetermined number are set within the predetermined tone range, and the predetermined number of the waveform samples selected are assigned to the partial tone ranges, respectively. In response to the pitch information, a partial tone range to which the pitch information belongs is detected from the partial tone ranges. A waveform sample assigned to the detected partial tone range is read. A musical tone is generated based on the read waveform sample.

16 Claims, 16 Drawing Sheets

ELECTRONIC MUSICAL INSTRUMENT CAPABLE OF ASSIGNING WAVEFORM SAMPLES TO DIVIDED PARTIAL TONE RANGES

BACKGROUND OF THE INVENTION

1. Field of the Invention

This invention relates to an electronic musical instrument which is capable of dividing a predetermined tone range into a plurality of partial tone ranges and assigning waveform samples to predetermined pitches within the partial tone ranges, respectively.

2. Prior Art

Conventionally, an electronic musical instrument is known, which has a plurality of waveform samples stored in a waveform memory, which are assigned, respectively, to corresponding partial tone ranges set at part of the whole tone range within which musical tones can be designated for sounding by means of a performance operating element, such as a keyboard, whereby to sound musical tones, waveform samples assigned to partial tone ranges to which pitches designated by keys of the keyboard belong are selectively read to thereby generate musical tones.

In such a conventional electronic musical instrument, a plurality of partial tone ranges are set for part of the whole tone range, as mentioned above. In setting the partial tone ranges, it is necessary to set separately and individually, for each of the partial tone ranges, a lower limit scale note (LL), an upper limit scale note (UL), and waveform-designating information for designating a waveform sample to be used in the partial tone range for sounding. Further, the pitch of a waveform sample to be sounded, i.e. the reading rate of the waveform sample, is adjusted for each partial tone range by setting a scale note shift amount, etc. according to the difference between the original pitch (ON: original note) of a corresponding waveform sample originally recorded and the standard pitch of each scale note within the partial tone range.

However, in the conventional electronic musical instrument, a plurality of partial tone ranges have to be manually set for part of the whole tone range, and waveform samples have to be assigned, respectively, to the partial tone ranges thus set, by manually designating the partial tone ranges one by one, which is very troublesome.

SUMMARY OF THE INVENTION

It is an object of the invention to provide an electronic musical instrument which is capable of reducing labor and time for individually setting parameters defining the partial tone ranges and assigning waveform samples to the respective partial tone ranges, thereby improving the operatability.

To attain the above object, the present invention provides an electronic musical instrument comprising:

memory means for storing a plurality of waveform samples;

selector means for selecting a predetermined number of waveform samples from the plurality of waveform samples stored in the memory means;

performance means for generating pitch information for designating a pitch within a predetermined tone range;

instructing means for instructing automatic assignment of waveform samples;

assigning means responsive to instructions for the automatic assignment from the instructing means, for setting partial tone ranges equal in number to the predetermined number, within the predetermined tone range, and for assigning the predetermined number of the waveform samples selected by the selector means to the partial tone ranges, respectively; and tone-generating means responsive to the pitch information from the performance means, for detecting from the partial tone ranges a partial tone range to which the pitch information belongs, for reading a waveform sample assigned to the detected partial tone range from the memory means, and for generating a musical tone based on the waveform sample read from the memory means.

According to the electronic musical instrument of the present invention constructed above, a predetermined number of waveform samples are selected by the selector means from a plurality of waveform samples stored in the memory means. Responsive to instructions for automatic assignment of waveform samples from the instructing means, the assigning means sets partial tone ranges equal in number to the predetermined number, within the predetermined tone range, and assigns the predetermined number of the waveform samples selected by the selector means to the partial tone ranges, respectively. Therefore, the user does not have to individually set parameters defining the partial tone ranges or assign waveform samples to the respective partial tone ranges, but instead he has only to make mere instructions for the automatic assignment whereupon the predetermined number of partial tone ranges are automatically set within the predetermined tone range and the predetermined number of waveform samples selected in advance are automatically assign to the partial tone ranges, respectively.

Preferably, the electronic musical instrument includes designating means for designating reference pitches, respectively, for the predetermined number of the waveform samples, and the assigning means automatically sets the predetermined number of partial tone ranges, respectively, based on the predetermined number of the reference pitches designated, respectively, for the predetermined number of the waveform samples.

According to this preferred embodiment, the electronic musical instrument is provided with reference pitches to be designated for assigning waveform samples, respectively, and the predetermined number of waveform samples selected are assigned to the partial tone ranges, based on the designated reference pitches. Therefore, it is possible to automatically assign waveform samples, respectively, to tone ranges which are suitable therefor.

More preferably, the reference pitches are each inherently exhibited by a corresponding one of the predetermined number of the waveform samples when the corresponding one waveform sample is read from the memory means at a predetermined reference reading rate.

According to this preferred embodiment, each of the reference pitches is a pitch inherent to a corresponding one of the predetermined number of the waveform samples, which is exhibited when it is read from the memory means at the predetermined reference reading rate. Therefore, the reference pitches can be designated in a uniform manner for the respective waveform samples to make it possible to carry out the automatic assignment without wavering in his designation. Further, for the sense of human hearing, it is desirable that waveform samples should be reproduced at pitches inherent thereto. This preferred embodiment meets the desire by making it possible to assign waveform samples to tone ranges suitable therefor.

Alternatively, the reference pitches are each set as desired as a pitch representative of a tone range to which a corresponding one of the predetermined number of waveform samples is desired to be assigned.

According to this preferred embodiment, the reference pitches can be set by manual inputting by the user as he desires, and the automatic assignment is executed based on the reference pitches thus input. Therefore, it is possible to automatically assign waveform samples to tone ranges defined based on the reference pitches which the user desires to allot to the waveform samples, respectively.

Preferably, the electronic musical instrument includes waveform sample-preparing means for preparing a new waveform sample, and for storing the new waveform sample into the memory means, and the selector means is responsive to the preparation of the new waveform sample, for selecting the new waveform sample in addition to the predetermined number of the waveform samples, the designating means designating a reference pitch for the new waveform sample, the assigning means setting a partial tone range for the new waveform sample, based on the designated reference pitch in addition to the predetermined number of the partial tone ranges already set, and for assigning the new waveform sample to the partial tone range set therefor.

According to this preferred embodiment, whenever a new waveform sample is prepared, the automatic assignment is automatically carried out. Therefore, performance based on assignment of waveform samples including the newly prepared one can be given immediately after the preparation of the new waveform sample.

Preferably, in assigning two waveform samples having respective reference pitches different from each other to two adherent partial tone ranges, the assigning means sets a pitch corresponding to a midpoint between the respective reference pitches of the two waveform samples as a border between the two adjacent partial tone ranges to which the two waveform samples are assigned, respectively.

According to this preferred embodiment, the border between two adjacent partial tone ranges to be assigned, respectively, with the two waveform samples is set to a midpoint between the respective reference pitches. Therefore, it is possible to automatically set the partial tone ranges corresponding to the respective waveform samples without overlapping each other, with the reference pitches being located at the centers of the respective partial tone ranges.

Preferably, the assigning means sets the predetermined number of the partial tone ranges within the predetermined tone range in such a manner such that the predetermined tone range is divided every predetermined number of pitches, starting from a predetermined pitch within the predetermined tone range.

Alternatively, the assigning means sets the predetermined number of the partial tone ranges within the predetermined tone range in such a manner that the predetermined tone range is equally divided by the predetermined number and the resulting divided tone ranges are set as partial tone ranges of the predetermined tone range.

According to these preferred embodiments, the partial tone ranges can be automatically set without setting reference pitches for waveform samples. Therefore, the automatic assignment can meet a desire to immediately listen to musical tones reproduced by arranging the selected waveform samples according to the partial tone ranges to which they are assigned.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
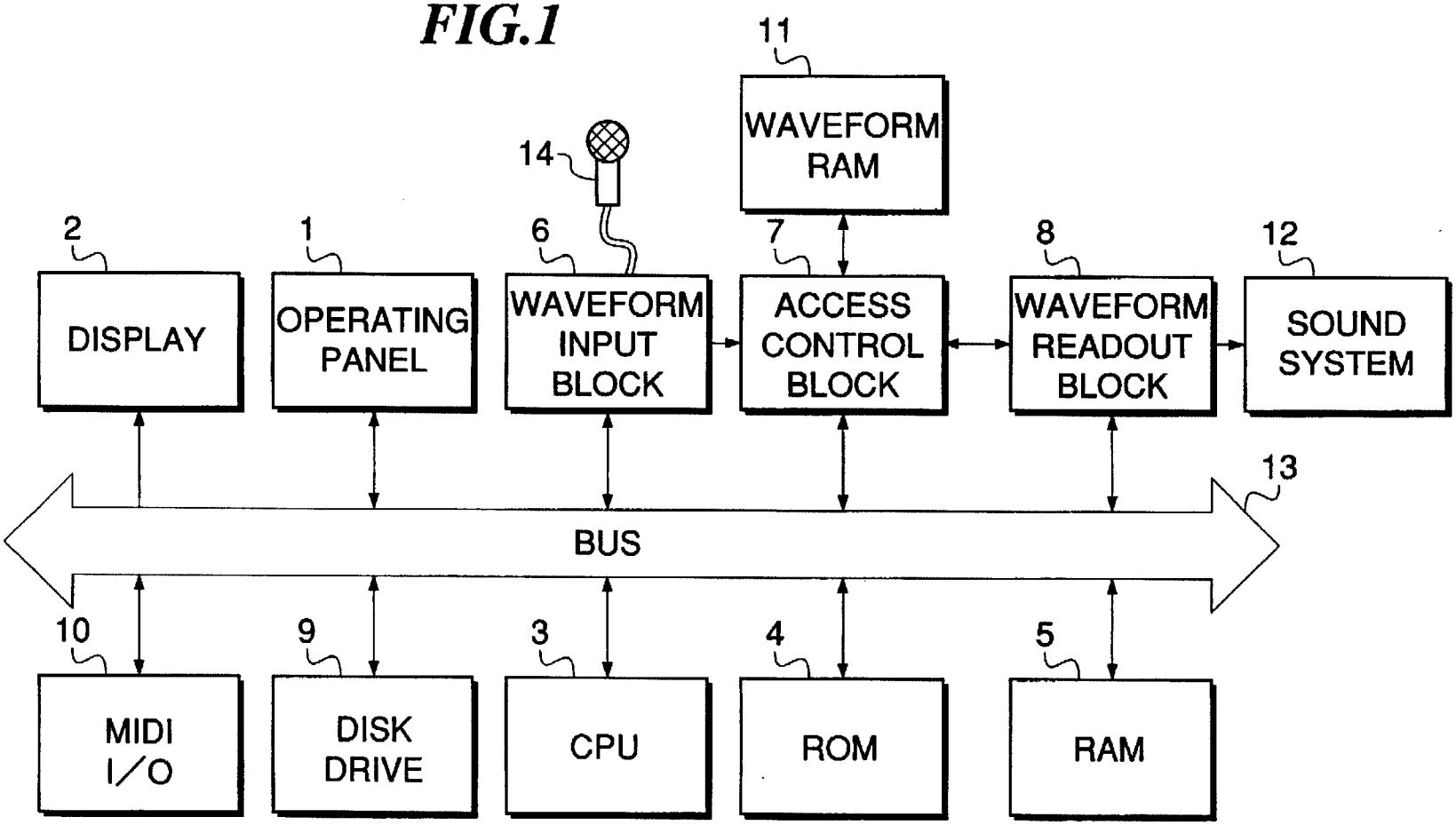
FIG. 1 is a block diagram schematically showing the whole arrangement of an electronic musical instrument according to an embodiment of the invention.

Referring first to FIG. 1, there is schematically shown the whole arrangement of an electronic musical instrument according to an embodiment of the invention.

As shown in the figure, the electronic musical instrument is comprised of an operating panel 1 for instructing sampling of musical tones, editing waveform samples obtained by the sampling, inputting various kinds of information, and so forth, a display 2 for displaying various kinds of information input by the operating panel 1, waveform samples, etc., a CPU 3 for controlling the operation of the entire instrument, a ROM 4 storing control programs executed by the CPU 3, table data referred to by the same, and so forth, a RAM 5 for temporarily storing results of calculations by the CPU 3, various kinds of information input by the operating panel 1, etc., a waveform input block 6 for sampling musical tones according to instructions from the operating panel 1, an access control block 7 for accessing a waveform RAM 11 for storing sampled waveforms of musical tones, to write or read waveform samples into or from the same, a waveform readout block 8 for instructing the access control block 7 to read out specific waveform samples, a disk drive 9 for driving a disk storing waveform samples, information (sample data) on each of the waveform samples, various kinds of tone parameters (voice data), etc., and reading these data or prestored data therefrom, a MIDI interface (I/O) 10 for inputting a MIDI (Musical Instrument Digital Interface) signal (code) received from an external electronic musical instrument or the like or outputting a MIDI signal to an external electronic musical instrument or the like, and a sound system 12 including a tone generator for generating a musical tone signal by assigning a waveform sample read from the waveform readout block 8 and various tone parameters to a sounding channel, and a loudspeaker for converting the musical tone signal generated by the tone generator into sounds. The elements 1 to 10 are connected to each other via a bus 13.

Connected to the waveform input block 6 is a microphone 14 for converting musical tones into an electric signal to sample the musical tones. The waveform input block 6 has its output connected to the input of the access control block 7, which in turn is connected to the waveform RAM 11 and the waveform readout block 8, and the waveform readout block 8 has its output connected to the input of the sound system 12.

The disk driven by the disk drive 9 may be a hard disk, a floppy disk, a CD-ROM, a magneto-optic disk, etc. In the following description, for the convenience of explanation, it is assumed that a magnetic disk (a hard disk or a floppy disk) is employed.

Figure 2:
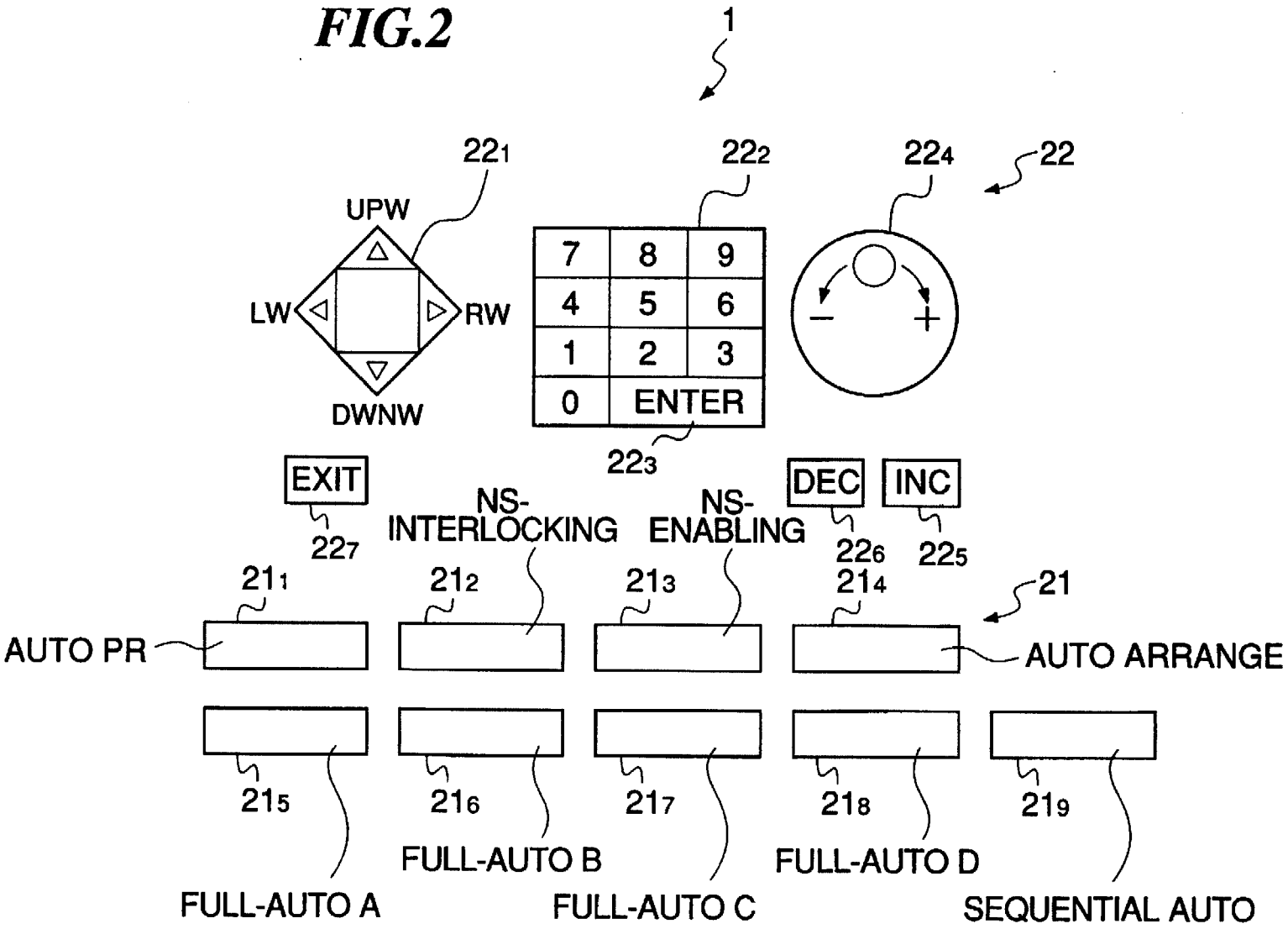
FIG. 2 is a diagram showing details of the arrangement of an operating panel appearing in FIG. 1.

FIG. 2 shows details of the construction of the operating panel 1. As shown in the figure, the operating panel 1 is comprised of a switch group 21 of function switches having respective functions assigned thereto, and another switch group 22 of other switches.

The function switch group 21 is comprised of nine kinds of function switches: an automatic post recording (PR) switch $21_1$, a note shift (NS)-interlocking switch $21_2$, a note shift (NS)-enabling switch $21_3$, an automatic arrangement switch $21_4$, a full-auto A switch $21_5$, a full-auto B switch $21_6$, a full-auto C switch $21_7$, a full-auto D switch $21_8$, and a sequential automatic switch $21_9$. The functions performed by depressing these switches will be described in the following:

The automatic post recording (PR) switch $21_1$gives instructions for executing a so-called post recording (PR) automatic processing for mapping (assigning) a new waveform sample based on a center note (ACN: hereinafter referred to as "assign center note") within a tone range designated by the user, to which the waveform sample is to be assigned, whenever the new waveform sample is obtained by sampling a waveform of musical tone.

As mentioned before, in assigning a waveform sample to an assign center note (ACN) in a specific tone range, based on which the waveform sample should be mapped, the user may wish to generate a musical tone having a pitch inherent to the musical tone originally sampled, i.e. at an original note (ON), instead of generating a musical tone having the pitch of the assign center note, in playing the assign center note. To meet such a demand, it is required to shift the pitch of the assign center note to that of the original note so as to generate a musical tone at its original note. To this end, the note shift (NS)-interlocking switch $21_2$ gives instructions for automatically setting an amount of note shift in a manner interlocked to the setting of the assign center note during execution of an ACN-setting event processing, described hereinafter with reference to FIG. 11. The amount of note shift may be separately set, i.e. in a non-interlocked manner.

The note shift (NS)-enabling switch $21_3$ enables the amount of note shift set as described above, so that a musical tone is generated at the original note, or imparts variation to the musical tone by merely shifting the pitch by the set amount of note shift. On the other hand, the switch $21_3$ may be used to disable the set amount of note shift to give instructions for generating a musical tone at a pitch corresponding to a note designated for performance.

The automatic arrangement switch $21_4$ gives instructions for executing a so-called automatic arrangement event processing for automatically remapping a waveform sample designated by a tone color (voice) based on its original note for the tone color (voice) for which the waveform sample has already been mapped, onto a predetermined tone range of the keyboard.

The full-auto A switch $21_5$ gives instructions for executing a full-auto A mapping processing for automatically mapping a waveform sample based on its original note. The full-auto B switch $21_6$ gives instructions for executing a full-auto B mapping processing for automatically mapping a waveform sample based on the assign center note. The full-auto C switch $21_7$ gives instructions for a full-auto C processing for equally dividing the whole tone range into tone ranges equal in number to the number of waveform samples to be mapped and automatically mapping the waveform samples, respectively, onto the divided or partial tone ranges. The full-auto D switch $21_8$ gives instructions for executing a full-auto D processing for dividing a tone range every n number of keys starting from a predetermined key (e.g. C1) and automatically mapping waveform samples, respectively, onto the divided tone ranges.

Further, the sequential automatic switch $21_9$ gives instructions for executing a sequential automatic mapping processing for automatically mapping a designated waveform sample by designating assign center notes one by one.

The other switch group 22 is comprised of a cursor switch $22_1$ for moving a cursor, when the cursor is displayed on the display 2 appearing in FIG. 1, in a desired direction, i.e., upward (UPW), downward (DWNW), rightward (RW), or leftward (LW), a ten key $22_2$ for directly inputting numerical values to change numerical data of various parameters and the like, an ENTER key $22_3$ for establishing information input by the ten key $22_2$ etc., a data-setting dial $22_4$ for continuously changing data on a parameter or the like pointed to by the cursor, an INC switch $22_5$ for incrementing the value of a parameter or the like pointed to by the cursor by an incremental amount of 1 whenever it is operated, a DEC switch $22_6$ for decrementing the value of a parameter or the like pointed to by the cursor by a decremental amount of 1 whenever it is operated, and an EXIT switch $22_7$ for canceling execution of a processing, such as mapping of a waveform sample.

Figure 3A:
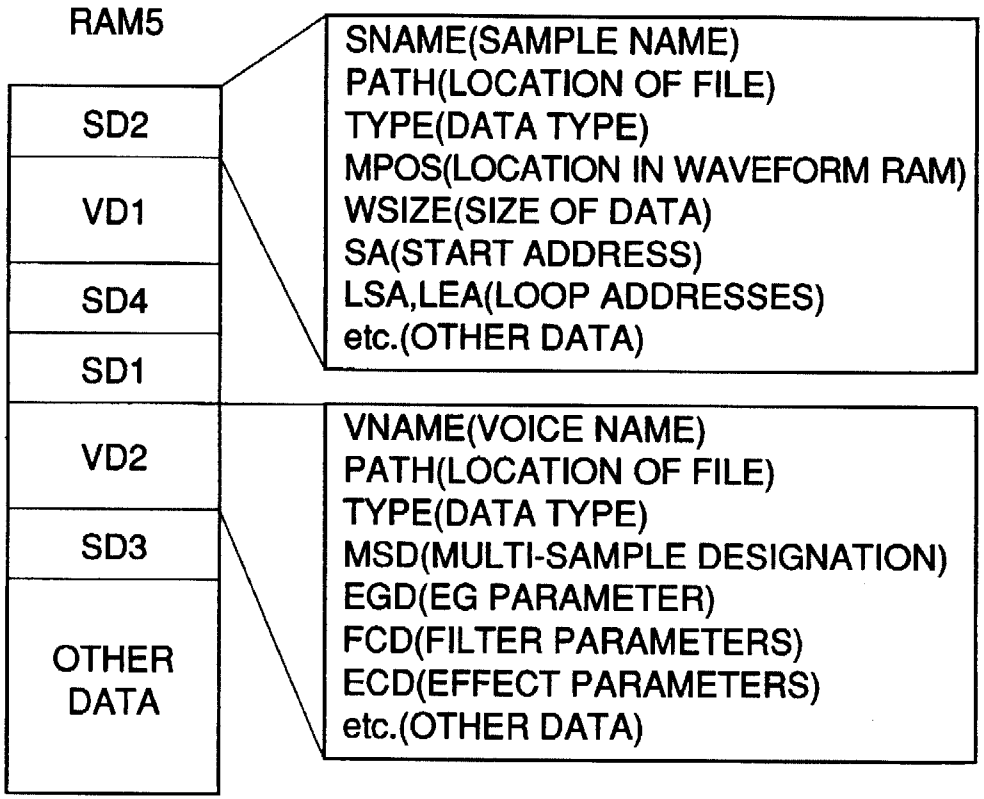
FIG. 3A shows a memory map of a RAM appearing in FIG. 1.
Figure 3B:
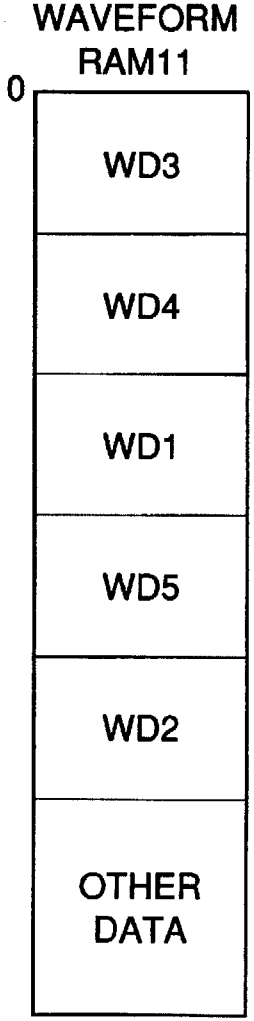
FIG. 3B shows a memory map of a waveform RAM appearing in the same.

FIG. 3A and FIG. 3B show memory maps which are stored within the RAM 5 and the waveform RAM 11 appearing in FIG. 1, respectively.

As shown in FIG. 3A, the RAM 5 stores sample data SD1 to SD4 as information on waveform samples, voice data VD1 and VD2 as information on tone colors (voices), and other data, which are stored in the magnetic disk or the waveform RAM 11.

Although only data formats of the sample data SD2 and the voice data VD2 are shown in FIG. 3A, the other sample data Sdn (n≠2) and the other voice data Vdn (N≠2) also have similar data formats.

The data format of the sample data SD2 has a region SNAME for storing a sample name (in the present embodiment, each waveform sample is controlled under the sample name), a region PATH for storing a storage location (address) including the name of a path, at which sample data (hereinafter referred to as "the sample data SD2") designated by the sample name is stored as a file, and the name of a drive to which is assigned the magnetic disk, a region TYPE for storing a data type for discriminating the attribute (type) of the sample data SD2 (i.e. sample data, voice data, or other data), a region MPOS for indicating a location in the waveform RAM 11 at which waveform data WD2 corresponding to the sample data SD2 is stored, a region WSIZE for storing data of the capacity of storage of the waveform data WD2, a start address region SA for storing data of a location (address) from which the waveform data WD2 starts to be read out, a loop start address region LSA for storing a start location (address) from which a portion of the waveform data WD2 starts to be repeatedly read out, a loop end address region LEA for storing an ending location (address) at which the repeated readout of the above portion ends, and an other data region for storing other data. Further, it is constructed such that wave data WDn is stored within the waveform memory 11, which corresponds to each sample data SDn (n=1, 2 . . . ). This is because when each sample data is obtained, waveform data WDn is sampled simultaneously, as will be described hereinafter.

On the other hand, the data format of the voice data VD2 has a region VNAME for storing a voice name, a region PATH for storing a location within the magnetic disk at which voice data designated by the voice name VD2 (hereinafter this voice data will be referred to as "voice data VD2") is stored and the name of a drive to which is assigned the magnetic disk, a region TYPE for storing a data type for discriminating the attribute of the voice data VD2, a multi-sample data region MSD for storing the maximum and minimum note numbers of partial tone ranges and data designating waveform samples assigned to the respective partial tone ranges, an EG data region EGD for storing values of various parameters delivered to an envelope generator (EG), not shown, within the sound system 12, a filter data region FCD for storing values of various parameters for filtering a musical tone signal generated by the tone generator, an effect data region ECD for storing values of various parameters delivered to effecters, not shown, within the sound system 12 when various effects are required to be imparted by the effecters to the musical tone signal, and an other data region for storing other data.

Further, as shown in FIG. 3B, the waveform RAM 11 stores waveform data WD1 to WD5 of waveform samples sampled via the waveform input block 6, and waveform data of waveform samples read from the magnetic disk by the disk drive 9, in the order of sampling or reading. The other data are stored at a region under the waveform data region.

Control operation carried out by the CPU 3 of the electronic musical instrument constructed as above will now be described with reference to FIGS. 4 to 13.

Figure 4:
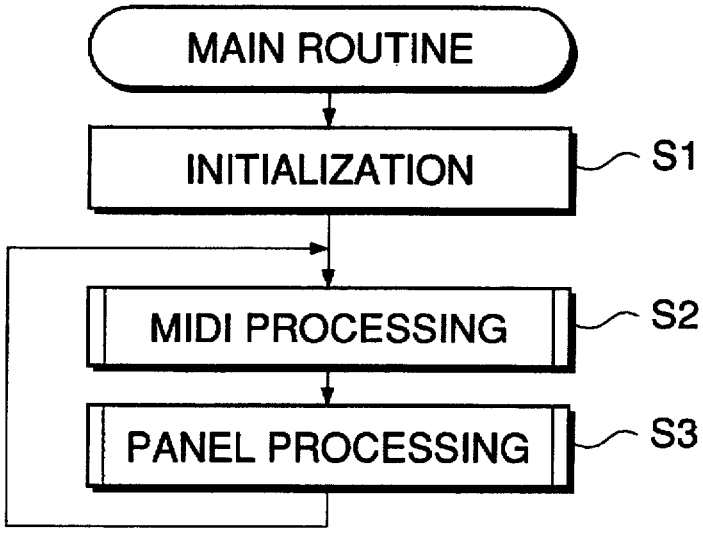
FIG. 4 is a flowchart showing a main routine executed by a CPU of the electronic musical instrument according to the embodiment.

FIG. 4 shows a main routine executed by the electronic musical instrument according to the present embodiment.

First, initialization is executed to clear the RAM 5 and ports, not shown, at a step S1.

Next, a MIDI processing is executed at a step S2 to carry out processings in response to a MIDI signal delivered from an external electronic musical instrument connected to the present electronic musical instrument. Then, a panel processing is executed at a step S3 to carry out various settings according to the operation of the operating panel 1, followed by the program returning to the step S2 to repeatedly carry out these processings.

Further, in the panel processing, if operation of any of the automatic post recording (PR) switch $21_1$, the note shift (NS)-interlocking switch $21_2$, and the note shift (NS)-enabling switch $21_3$ is detected, a correspondent event routine, not shown, is executed to set an automatic PR flag, an NS-interlocking flag, or an NS-enabling flag stored in a predetermined region within the RAM 5. When any of these flags is detected to have been set, the CPU 5 carries out a processing corresponding to the flag, as hereinafter described.

Figure 5:
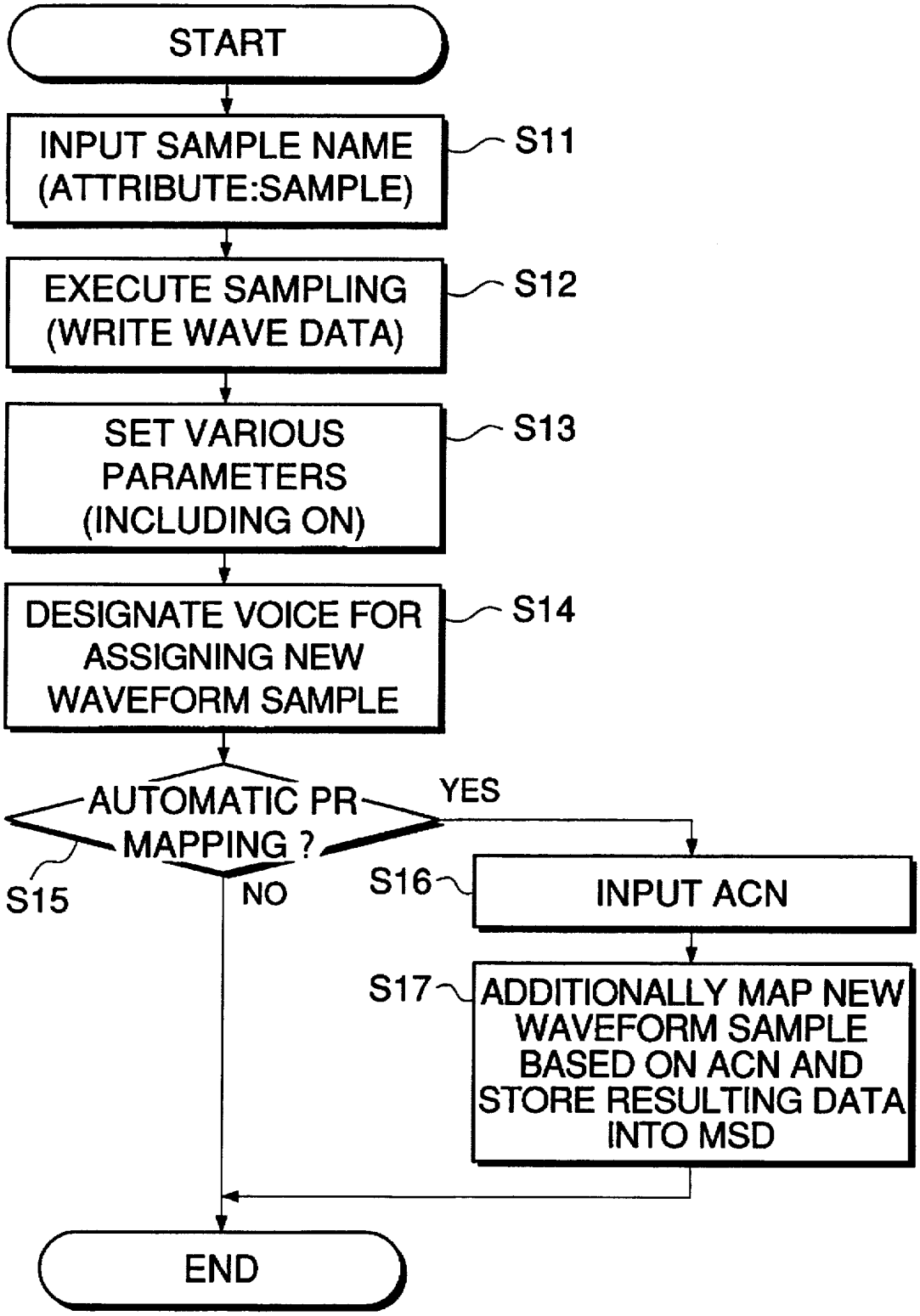
FIG. 5 is a flowchart showing a sampling event processing subroutine executed during a panel processing at a step S3 of the FIG. 4 main routine, for sampling a musical tone signal to generate a waveform sample.

FIG. 5 shows a sampling event processing forming part of the panel processing executed at the step S3 in FIG. 4, for sampling musical tones to thereby prepare waveform data and sample data corresponding thereto. This sampling event processing is called into execution by depressing a sampling switch, not shown, of the operating panel 1.

First, at a step S11, a request for inputting a sample name (including a location of a file to be stored in the region PATH) is displayed on the display 2. When the sample name is input according to this request, a sampling processing is carried out such that a musical tone is sampled via the microphone 14 and the waveform input block 6, and the resulting waveform data is written into the waveform RAM 11 at a step S12. More specifically, in the sampling processing, a musical tone signal is input via the microphone 14 and the waveform input block 6, and when the CPU detects a rise of the signal, it starts writing the signal into the waveform RAM 11 from the time point of the rise detection, and terminates writing at a time point a region of the RAM allocated thereto is filled with the musical tone signal.

Next, at a step S13, setting is made of values of parameters of the sample data SDn previously described with reference to FIG. 3A, i.e. the start address SA, the loop start address LSA, the loop end address LEA, etc. The setting of the addresses SA, LSA, and LEA may be carried out, based upon waveform data which are displayed on the display 2, or alternatively, it may be carried out by reproducing and monitoring the waveform data before finally determining values of the addresses. Further, when a musical tone is sampled, the pitch peculiar to the musical tone, i.e. the original note (ON), which inherently exists, is set as well at the step S13. The original note may be automatically set to a pitch corresponding to the basic frequency of a sampled musical tone by the use of a known technique of analyzing the basic frequency.

Next, a voice name which the user wishes to assign to the waveform sample (new waveform sample) selected in advance is stored into the region VNAME within the RAM 5 allocated thereto (hereinafter, the voice name stored in the region VNAME will be referred to as "the voice VN"), at a step S14. Then, it is determined at a step S15 whether or not the automatic post recording (PR) switch $21_1$ has been depressed, i.e. whether or not the automatic PR flag has been set. If the automatic PR flag has not been set (automatic PR flag=0), the present sampling event processing is terminated, whereas if the automatic PR flag has been set (automatic PR flag=1), the user inputs an assign center note as desired according to the request of inputting the assign center note. The value of the assign center note thus input is stored into a region ACN within the RAM 5 allocated thereto (hereinafter the assign-center note stored in the region ACN will be referred to as "the assign center note ACN") at a step S16. Based on the assign center note ACN, the new waveform sample is additionally mapped. Results of the mapping, i.e. the assign center note ACN, the maximum and minimum note numbers (the upper limit UL and the lower limit LL) of each partial tone range, and data designating the waveform sample assigned thereto, etc. are stored into the multi-sample data region MSD of the voice data designated by the voice VN at a step S17, followed by terminating the present sampling event processing routine.

Figures 14A, 14B, 14C, 14D, 14E:
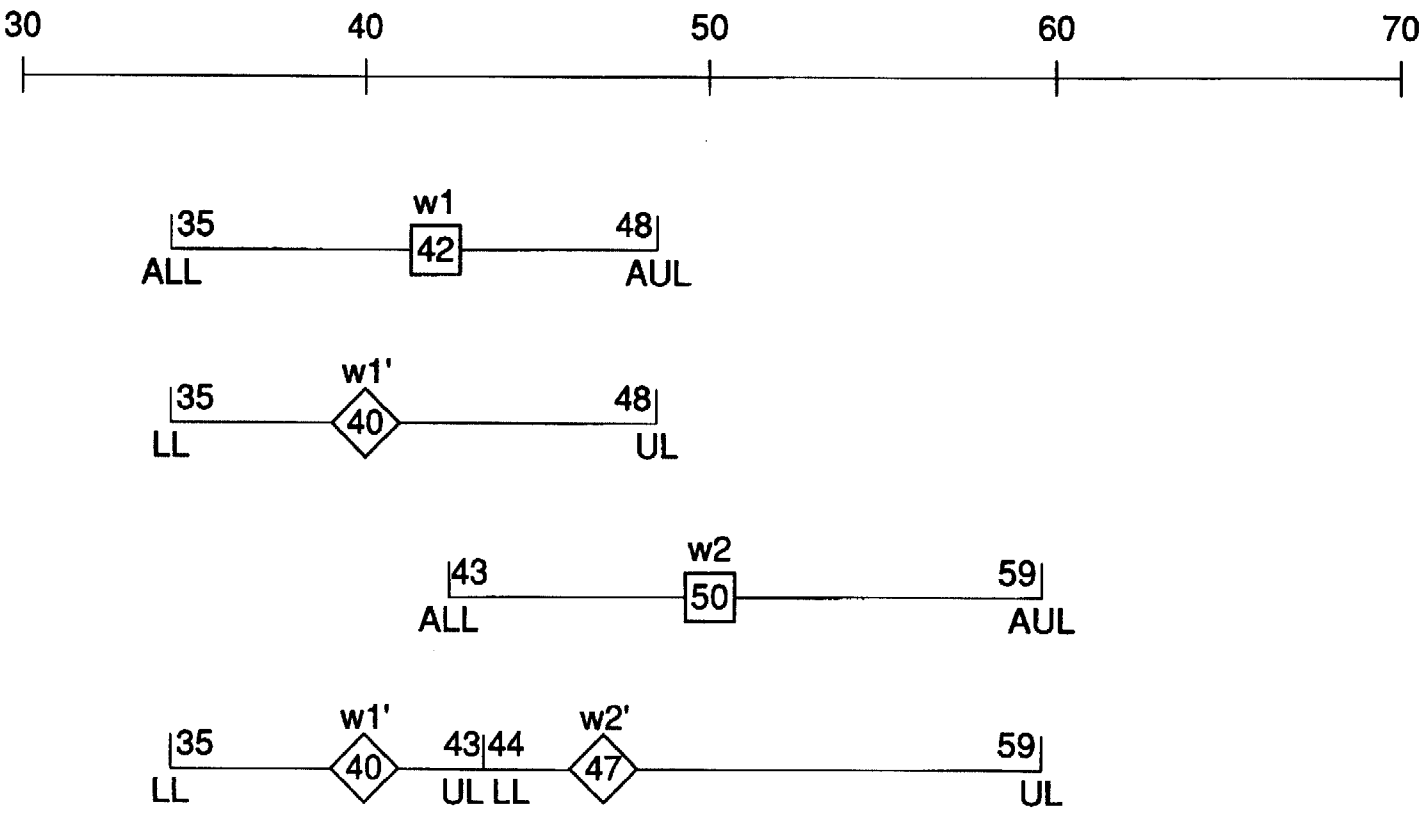
FIGS. 14A to 14E are diagrams which are useful in explaining an additional mapping processing executed at a step S17 of the FIG. 5 subroutine.

FIGS. 14A to 14E are diagrams useful in explaining how the additional mapping processing is carried out. FIG. 14A shows a scale of note numbers, FIG. 14B a waveform sample w1 originally obtained by recording and an original note (=42) thereof, FIG. 14C a waveform sample w1' obtained by applying an assign center note (=40) to the FIG. 14A waveform sample w1, FIG. 14D a new waveform sample w2 which the user wishes to additionally map onto the FIG. 14C waveform sample w1' and an original note (=50) thereof, and FIG. 14E waveform samples w1', w2' obtained by additional mapping of the FIG. 14D waveform sample w2 and assign center notes (=40 , 47) thereof. It should be noted that the FIG. 14A scale is graduated with MIDI note numbers, and in the present embodiment, a waveform sample is assigned to any tone range set within the range defined by the note number 30 and the note number 70.

First, when the FIG. 14B waveform sample w1 is obtained by sampling, for example, values of various parameters are set at the step S13. More specifically, the original note ON as well as an upper limit (AUL: Assign Upper Limit) and a lower limit (ALL: Assign Lower Limit) of the note number for assigning the waveform sample w1 are set. The upper limit and the lower limit are stored into regions AUL, ALL of the RAM 5 allocated thereto (hereinafter, contents in the regions AUL, ALL will be referred to as "the upper limit AUL"0 and "the lower limit ALL", respectively). Here, the upper limit AUL and the lower limit ALL are set to prevent the waveform of the reproduced musical tone from being distorted, which is liable to occur when a too large shift of the pitch (which is effected by changing the rate of reading the waveform sample) is made to the waveform sample. In this way, the waveform data of the waveform sample w1 having the original note =42, the lower limit ALL=35, and the AUL=48 is sampled=48 is sampled and stored into the waveform RAM 11.

Next, when "40"0 is input as an assign center note ACN at the step S16, mapping is carried out as shown in FIG. 14C, and the assign center note, the upper limit of a partial tone range resulting from the mapping (i.e. the aforementioned upper limit UL) and the lower limit of the partial tone range (i.e. the aforementioned the lower limit LL) are stored into the multi-sample data region MSD.

Further, when a new waveform sample, e.g. the FIG. 14D waveform w2, is obtained by sampling, waveform data having an original note=50, a lower limit ALL=43, and an upper limit AUL=59 is stored into the waveform RAM 11, similarly to the waveform sample of FIG. 14B.

Then, when "47"0 is input as an assign center note ACN at the step S16, mapping is carried out as shown in FIG. 14E, and as sample data indicative of the waveform sample w2', the assign center note=47, the upper limit UL of a partial tone range resulting from the mapping=59, the lower limit LL of the partial tone range=44 are stored into the multi-sample data region MSD. The additional mapping of the waveform sample w2' results in a change of the state of assignment of the waveform sample w1' (i.e. its upper limit UL is changed from "48"0 to "43"). Accordingly, the value of the waveform sample w1' stored in the multi-sample data region MSD is updated and stored.

Figure 6:
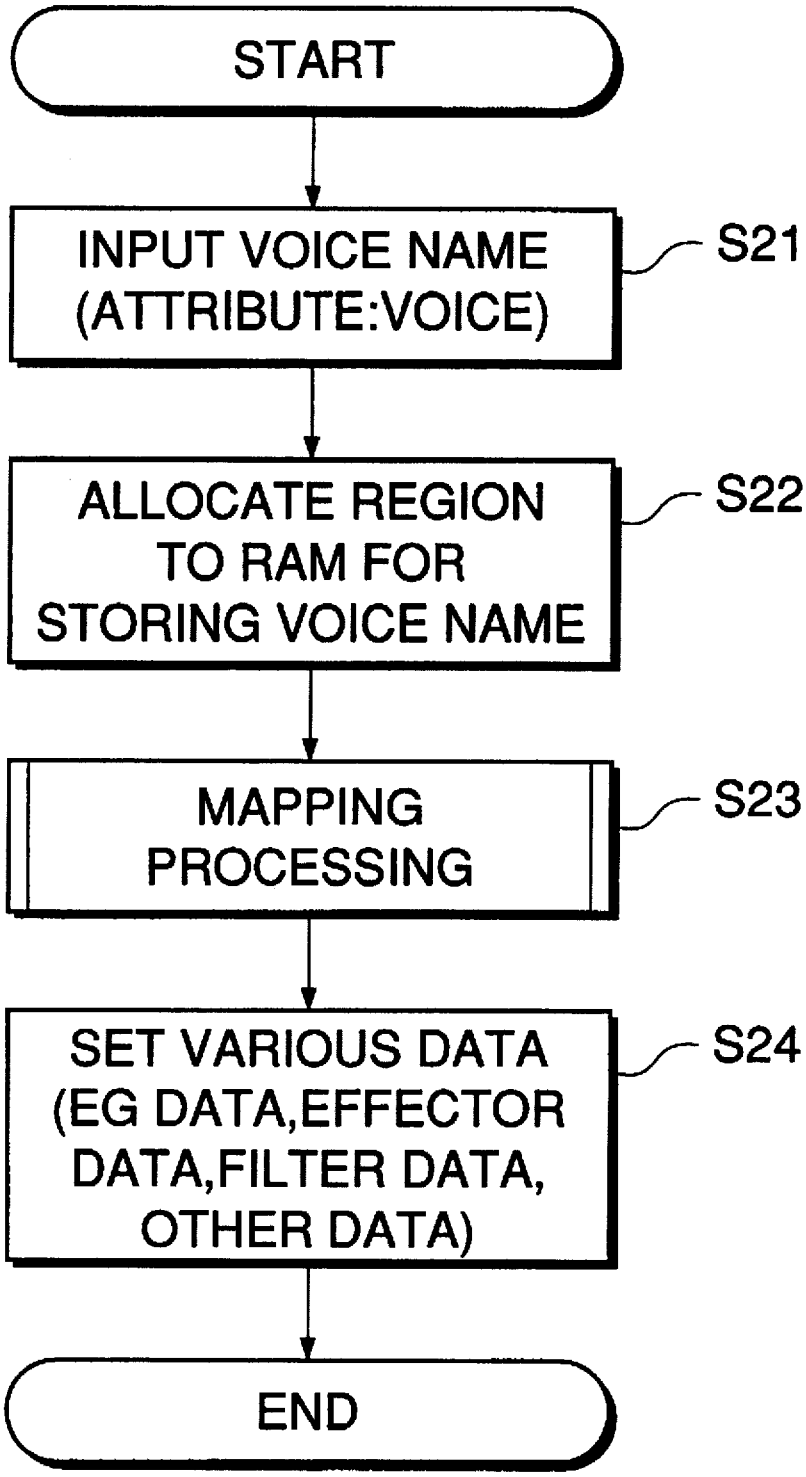
FIG. 6 is a flowchart showing a subroutine for a new voice data-preparing event processing executed during the panel processing for preparing new voice data.

FIG. 6 shows a new voice data-preparing event processing subroutine executed during the panel processing at the step S3 of the FIG. 4 main routine, for newly preparing voice data. The new voice data-preparing event processing is called into execution by depressing a new voice data-preparing event switch, not shown, of the operating panel 1.

In the figure, similarly to the step S11 in FIG. 5, a voice name is input at a step S21, and a region for storing the voice data is allocated within the RAM 5 at a step S22. Then, a mapping processing subroutine, described hereinafter, is carried out at a step S23, and further, setting is made of values of various parameters related to the voice, which are set into the EG data region EGD, the filter data region FCD, the effect data region ECD, and the other data region at a step S24, followed by terminating the new voice data-preparing event processing subroutine.

By selecting the obtained voice data for the voice (tone color) for sounding, a musical tone controlled in respect of the tone color based on the voice data is generated according to performance information input via the MIDI interface 10.

The voice data may be changed not only by the new voice data-preparing event processing in preparation of new voice data, but also by a voice-editing event processing, not shown, carried out on voice data already prepared.

Figure 7:
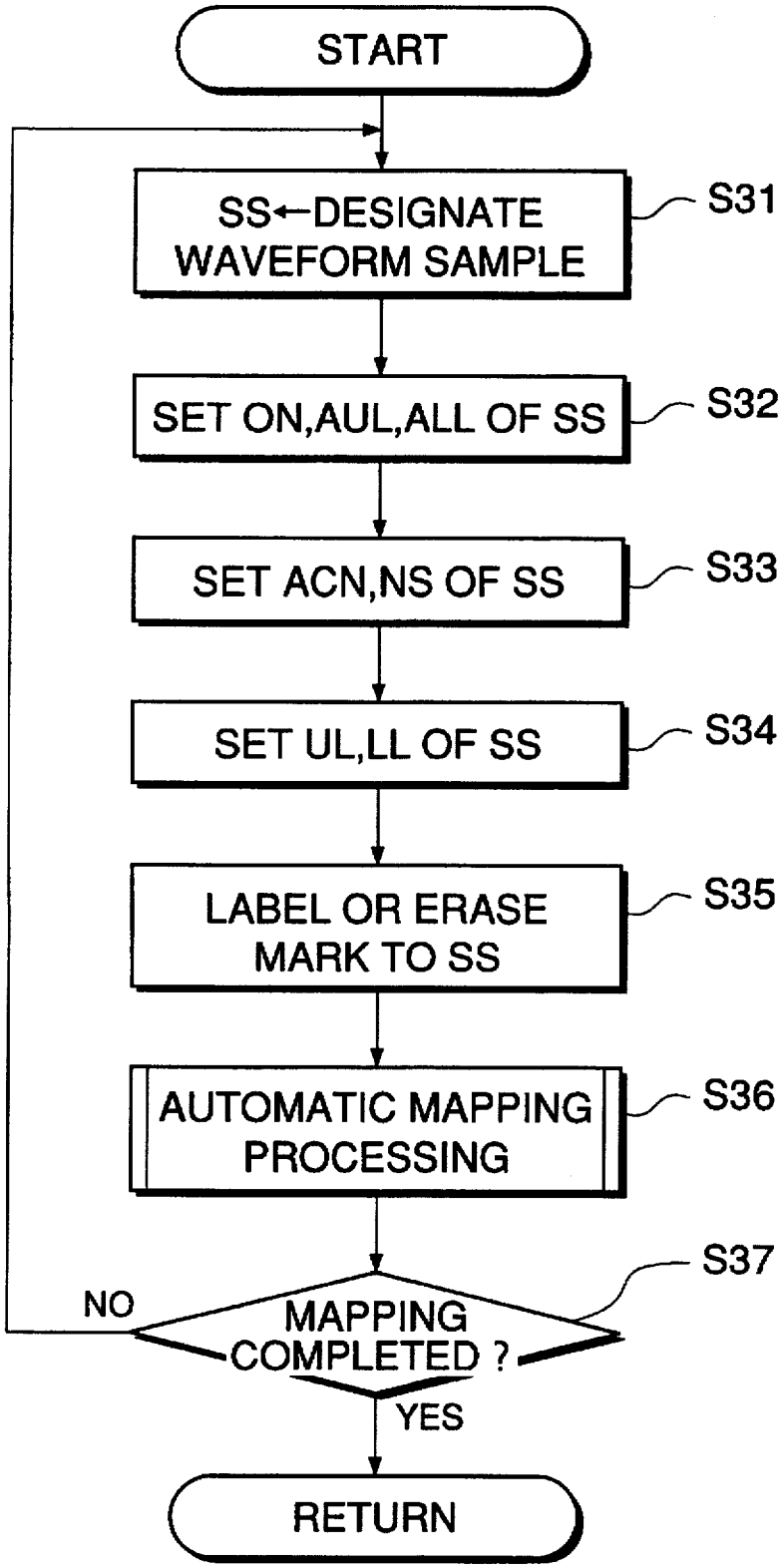
FIG. 7 is a flowchart showing a mapping processing subroutine executed at a step S23 of the FIG. 6 subroutine.

FIG. 7 shows details of the mapping processing subroutine executed at the step S23 in FIG. 6.

First, when the user designates a desired one from among a plurality of sample data, not shown, displayed on the display 2, the sample name of the designated sample data stored in the region SNAME is stored into a region SS of the RAM 5 allocated thereto (hereinafter the waveform sample designated by the sample name will be referred to as "the designated waveform sample") at a step S31.

Next, the original note of the designated waveform sample SS is manually set into a region ON (hereinafter the original note set in the region ON will be referred to as "the original note ON") of the RAM 5 allocated thereto, and an upper limit value (the aforementioned upper limit AUL) and a lower limit value (the aforementioned lower limit ALL) of the note number for assigning the designated waveform sample SS are manually set at a step S32. The present embodiment is thus constructed such that the original note ON can be manually set, because the user may wish to change the original note, which has been automatically set at the step S13 of the FIG. 15 sampling event processing. For the same reason, the embodiment is also constructed such that the upper limit AUL and the lower limit ALL can be changed.

Next, an assign center note ACN and an amount of note shift NS are manually set for the designated waveform sample SS at a step S33. The assign center note ACN as a central pitch for the assignment is set by executing an assign center note (ACN)-setting event processing shown in FIG. 11, hereinafter described, according to operation of the operating panel 1. The manual setting of the amount of note shift NS is thus made possible in order to enable the amount of note shift NS to be set afterwards in the case where an NS-interlocking processing (step S73) to be activated by the NS-interlocking switch $21_2$ is not executed so that the amount of note shift is not set, during the assign center note (ACN)-setting event processing, or in the case where the user wishes to change the amount of note shift NS even if it has already been set.

Next, an upper limit (the aforementioned upper limit UL) and a lower limit (the aforementioned lower limit LL) of a partial tone range resulting from mapping of the designated waveform sample SS are manually set and stored into regions UL, LL of the RAM 5 allocated thereto at a step S34. The setting of the upper limit UL and the lower limit LL is thus made possible in order to cope with a case in which the user wishes to carry out manual mapping instead of the automatic mapping executed at a step S36 of the present processing described hereinbelow, or he wishes to carry out fine adjustment after the automatic mapping.

Further, instructions are given at a step S35 to label or erase a mark designating whether or not the designated waveform sample SS should be an object of the automatic mapping. In this connection, the instructions at the step S35 can be given with enhanced operatability, by toggling to alternately cause labeling and erasing of the mark each time a mark switch, not shown, is depressed.

Next, when any of the aforementioned switches for the automatic mapping is operated, a corresponding automatic mapping processing subroutine is executed at the step S36 to carry out the automatic mapping based on the set values so far set, and it is determined at a step S37 whether or not the mapping has been completed.

If it is determined at the step S37 that the mapping has been completed, the subroutine is terminated, whereas if the mapping has not been completed, the program returns to the step S31, to repeatedly execute the above procedure.

When the user wishes to terminate the mapping processing, he depresses the EXIT switch $22_7$ appearing in FIG. 2, whereby the answer to the question of the step S37 is made affirmative to terminate the present mapping processing routine.

The present embodiment carries out five kinds of automatic mapping processing: full-auto A to D mapping processings, and a sequential automatic mapping processing, which correspond, respectively, to the function switches $21_5$ to $21_9$ described hereinbefore with reference to FIG. 2. Next, each of these automatic mapping processings will be described in detail.

Figure 8:
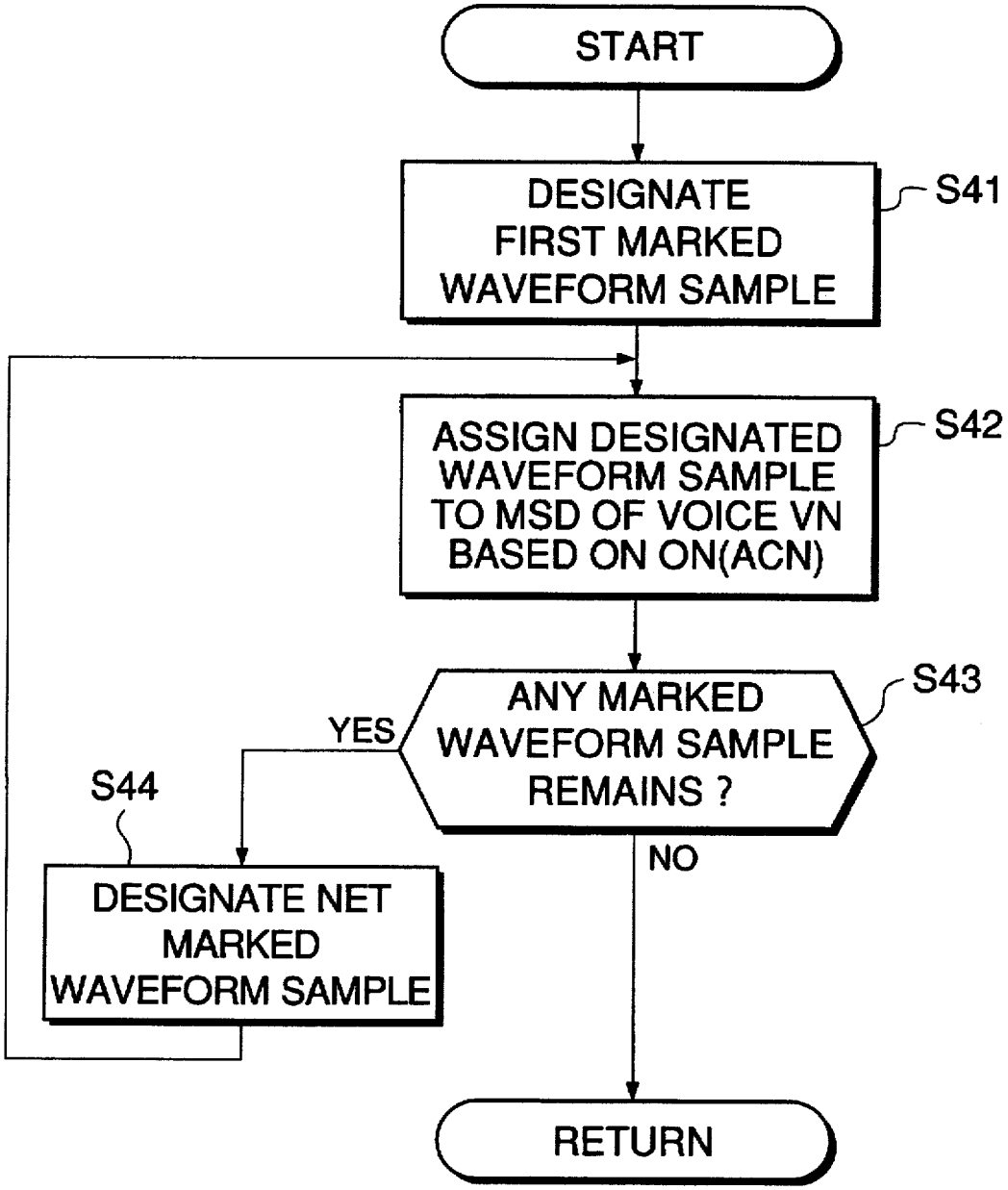
FIG. 8 is a flowchart showing subroutines for full-auto A/full-auto B mapping processings.

FIG. 8 shows subroutines for the full-auto A and full-auto B mapping processings. As described hereinbefore, the full-auto A mapping processing carries out mapping based on the original note ON, whereas the full-auto B mapping processing carries out mapping based on the assign center note ACN. The two processings are distinguished from each other only in this respect. Therefore, in the FIG. 8 flowchart, description is mainly made of the full-auto A mapping processing, and in the figure, the symbol ACN in parentheses means that the assign center note ACN can be used instead of the original note ON, to thereby execute the full-auto B mapping processing.

First, a first marked waveform sample is designated (selected) at a step S41, and the designated waveform sample is assigned to the multi-sample data region MSD of the voice data designated by the voice VN at a step S42. Mere specifically, the data to be stored into the multi-sample data region MSD, i.e. the maximum and minimum note numbers (the upper limit UL and the lower limit LL) of a partial tone range after the assignment, the waveform sample assigned to the partial tone range, etc. are determined and stored into the region MSD.

Next, it is determined at a step S43 whether or not any other marked waveform sample exists. If any other marked waveform sample remains to be designated, the other waveform sample is designated at a step S44, and then the program returns to the step S42 to repeatedly carry out the above procedure. On the other hand, if no other marked waveform sample exists, the present subroutine is terminated.

Figures 15A, 15B, 15C, 15D, 15E:
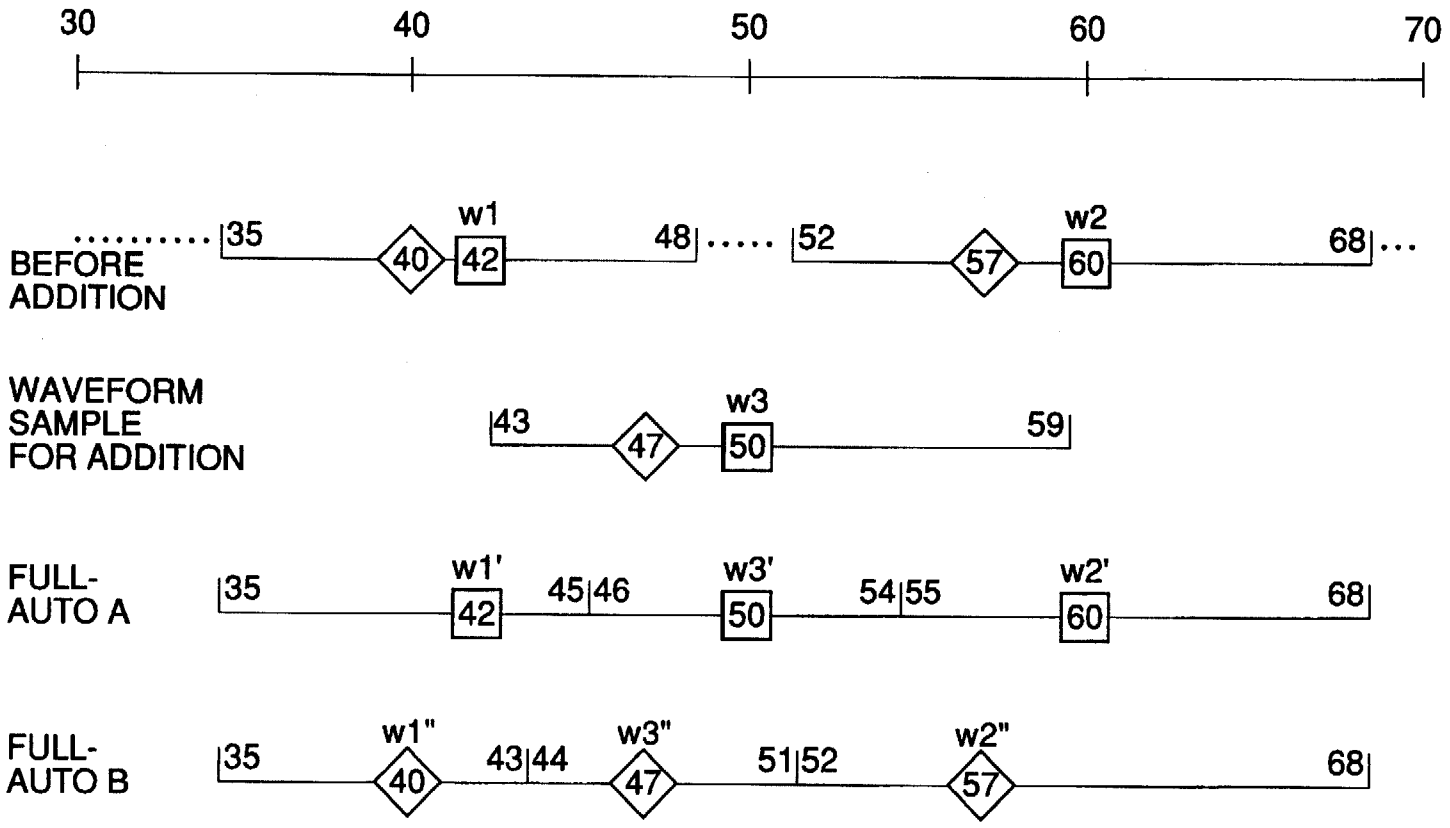
FIGS. 15A to 15E are diagrams which are useful in explaining the full-auto A/full-auto B mapping processings executed by the FIG. 8 subroutine.

FIGS. 15A to 15E show how the full-auto A/full-auto B mapping processings are carried out. FIG. 15A shows a scale of note numbers, FIG. 15B waveform samples w1, w2 already mapped before additional mapping, FIG. 15C a waveform sample w3 to be additionally mapped, FIG. 15D results of the additional mapping executed by the full-auto A mapping processing, and FIG. 15E results of the additional madding executed by the full-auto B mapping processing.

As shown in FIG. 15B, the waveform sample w1 is assigned to a tone range defined by an upper limit UL of 48 and a lower limit LL of 35 with an original note ON of 42 and an assign center note of 40, while the waveform sample w2 to a tone range defined by an upper limit UL of 68 and a lower limit LL of 52 with an original note ON of 60 and an assign center note of 57. The additional waveform sample w3 shown in FIG. 15C is provided with an original note ON of 50, an assign center note of 47 and assigned to a tone range defined by an upper limit AUL of 59 and a lower limit ALL of 43.

When the waveform samples w1 to w3 are subjected to the full-auto A mapping processing, the mapping result is as shown in FIG. 15D. For example, the border between a tone range of the mapped waveform sample w1' and a tone range of the mapped waveform sample w3' is determined such that it lies at the midpoint of a line connecting between the original notes of the two waveform samples. More specifically, the note number setting a higher limit or border to the resulting waveform sample w1' is "45"0 while the note number setting a lower limit or border to the resulting waveform sample w3' is "46". In the illustrated case, the number of note numbers (corresponding to the number of keys of the keyboard) existing between the original notes of the two waveform samples is an odd number (7), and therefore, strictly speaking, the border cannot lie exactly at the midpoint. In other words, the border cannot be set at a point of the line connecting therebetween obtained by equally dividing the line by note numbers. Therefore, in the waveform sample on the higher pitch side (in the present example, the waveform sample w3') the border is set to a location larger by one in the number of note numbers from the original note than the waveform sample on the lower pitch side (waveform sample w1'). This is not limitative, but inversely the waveform sample on the lower pitch side may have its border set to a location larger by one in the number of note numbers from the original note.

When the waveform samples w1 to w3 are subjected to the full-auto B mapping processing, the mapping result is as shown in FIG. 15E, with assign center notes thereof located at centers of respective partial tone ranges. The manner of mapping is similar to that of the full-auto A mapping described above, and therefore description thereof is omitted.

Figure 9:
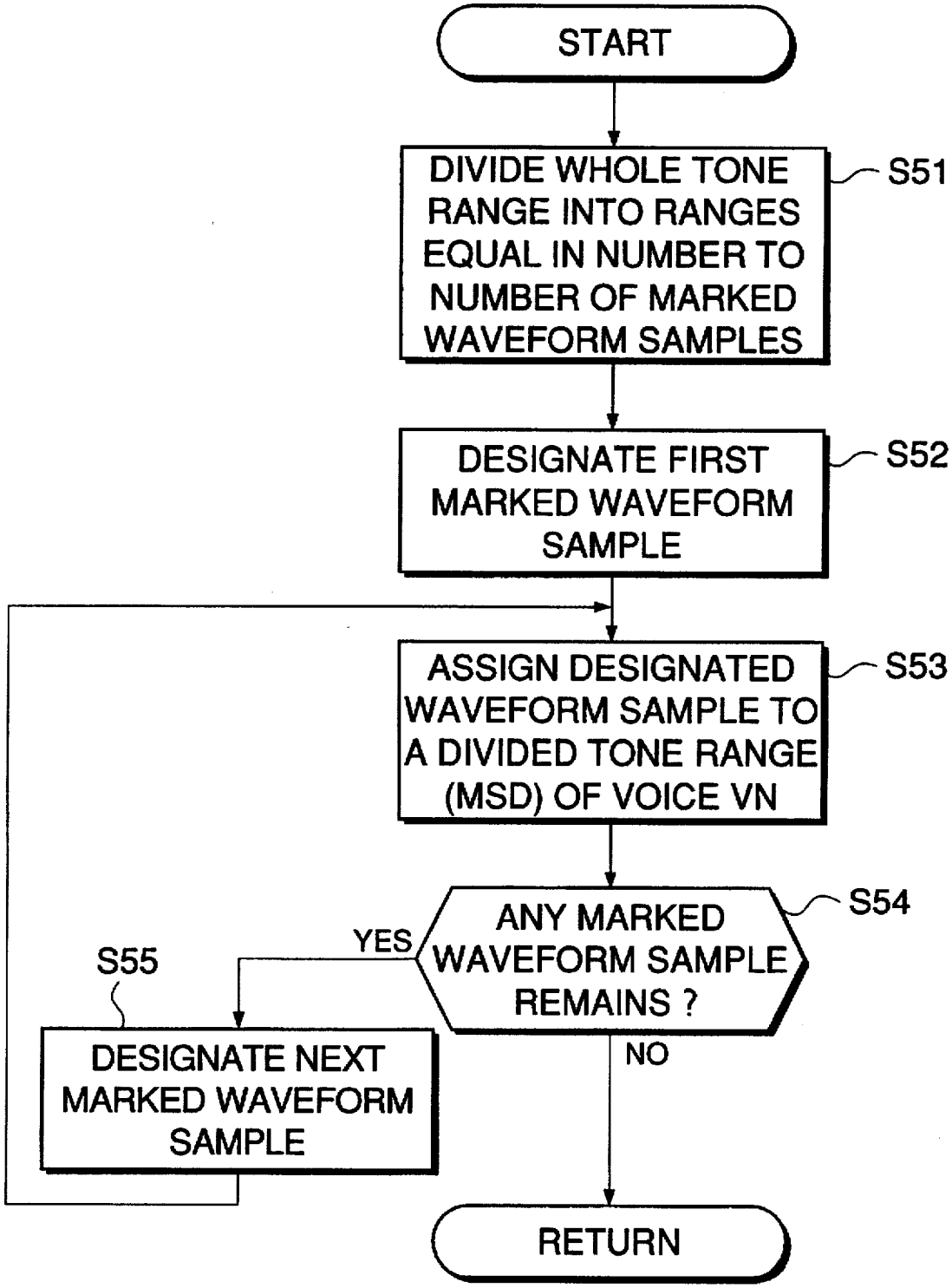
FIG. 9 is a flowchart showing subroutines for full-auto C/full-auto D mapping processings.

FIG. 9 shows a subroutine for the full-auto C/full-auto D mapping processings. As previously described, the full-auto C mapping processing carries out equally dividing the whole tone range into partial tone ranges equal in number to the number of marked waveform samples and automatically mapping the waveform samples onto the divided or partial tone ranges, whereas the full-auto D mapping processing carries out dividing the whole tone range every k number of keys (the value k is designated by another routine, not shown) starting from a predetermined key (e.g. "C1") and automatically mapping waveform samples onto the divided tone ranges. The full-auto C mapping processing and the full-auto D mapping processing are distinguished from each other only in this respect. FIG. 9 collectively shows both the mapping processings.

First, the whole tone range designated by the voice (tone color) VN is divided into partial tone ranges equal in number to the number of marked waveform samples at a step S51. Here, the full-auto C mapping equally divides the whole tone range into partial tone ranges equal in number to the number of waveform samples, whereas the full-auto D mapping divides the whole tone range every k number of keys starting from a predetermined key into portions each covering the k number of keys.

The following steps S52 to S55 of this subroutine are the same as the steps S41 to S44 in FIG. 8 described above, and therefore description thereof is omitted.

Figures 16A, 16B, 16C:
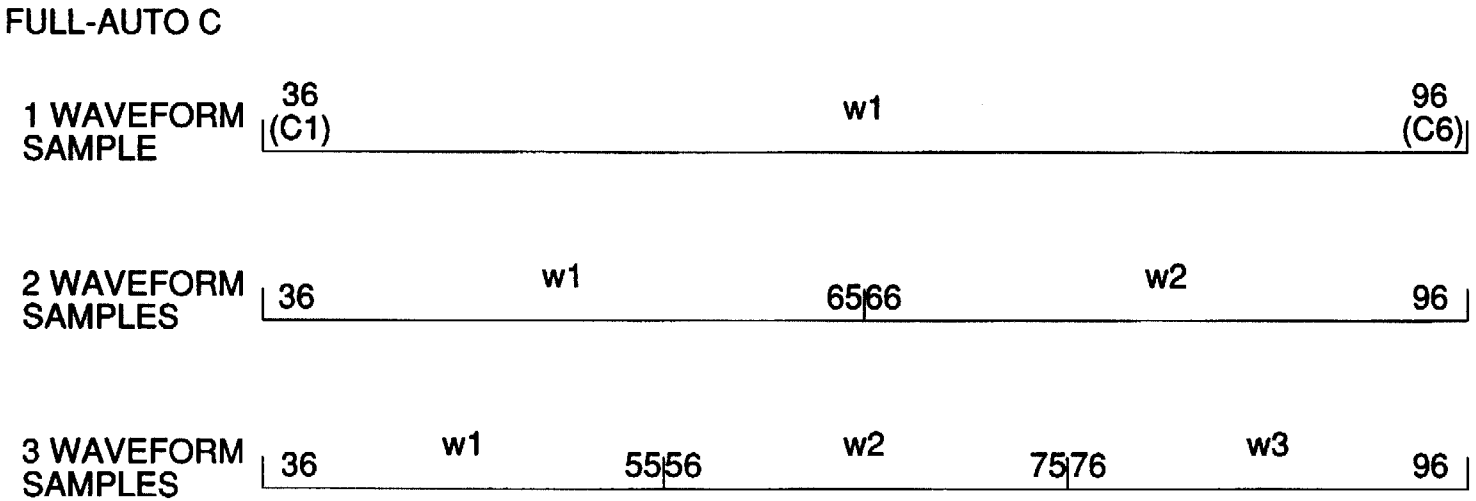
FIGS. 16A to 16C are diagrams which are useful in explaining the full-auto C mapping processing executed by the FIG. 9 subroutine.

FIGS. 16A to 16C show how the full-auto C mapping processing is carried out, while FIGS. 17A to 17D show how the full-auto D mapping processing is carried out.

FIGS. 16A to 16C show results of the automatic mapping of one to three waveform samples, respectively. In FIG. 16A, a waveform sample w1 is mapped onto the whole tone range from the note number of 36 (=C1) to the note number of 96 (=C6). In FIG. 16B, waveform samples w1 and w2 are mapped onto tone ranges obtained by equally dividing the whole tone range by two. In FIG. 16C, waveform samples w1 to w3 are mapped onto three equal tone ranges obtained by equally dividing the whole tone range by three. The original pitch of each waveform sample is set at the midpoint of a corresponding partial tone range. Therefore, as the position of a note to be sounded becomes away from the location of the original pitch rightward or leftward as viewed in the figures, a musical tone modified only in pitch to a higher value or to a lower value is generated.

Figures 17A, 17B, 17C, 17D:
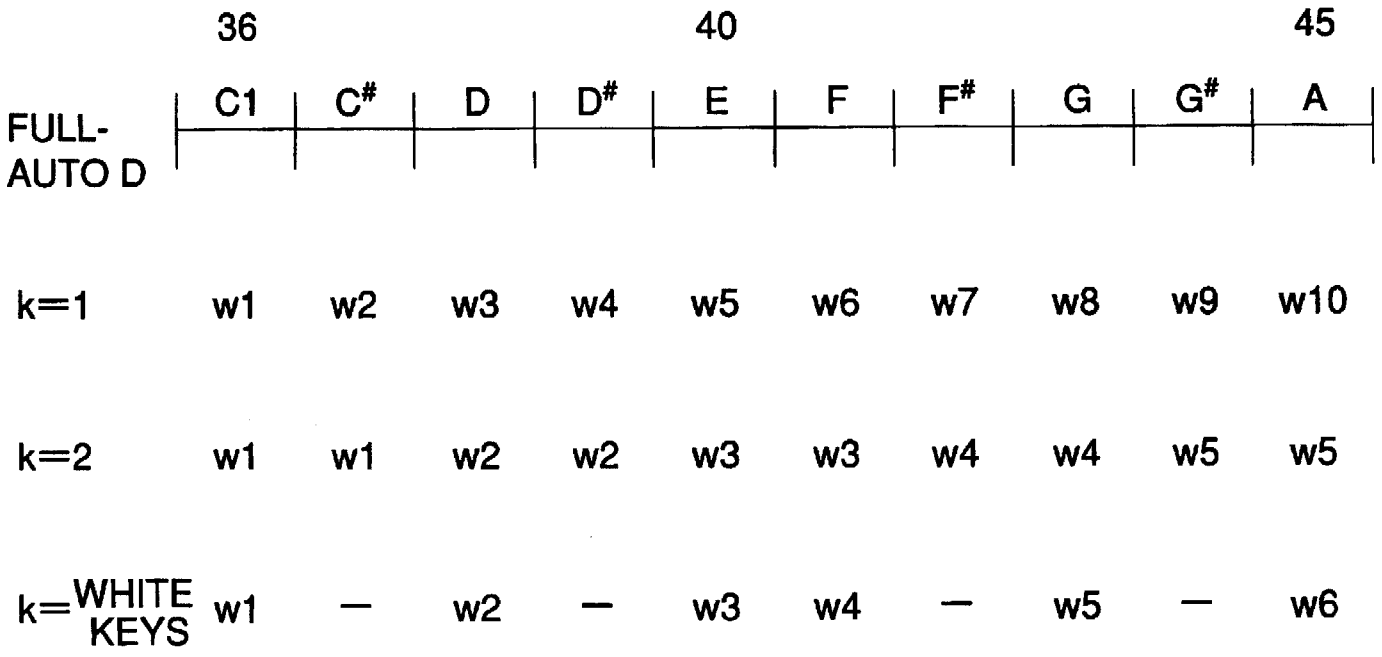
FIGS. 17A to 17D are diagrams which are useful in explaining the full-auto D mapping processing executed by the FIG. 9 subroutine.

FIG. 17A shows a scale of tone numbers (notes) within a tone range for the full-auto D mapping processing. FIG. 17B shows results of automatic mapping of waveform samples executed every one key or note (k=1). FIG. 17C shows results of automatic mapping of waveform samples executed every two keys or notes (k=2). FIG. 17D shows results of automatic mapping of waveform samples executed for respective white keys (k=white keys). Although in the FIG. 17C automatic mapping, each waveform sample is assigned with an equal pitch for every two keys, this is not limitative, but the pitch may be varied for every key.

Figure 10:
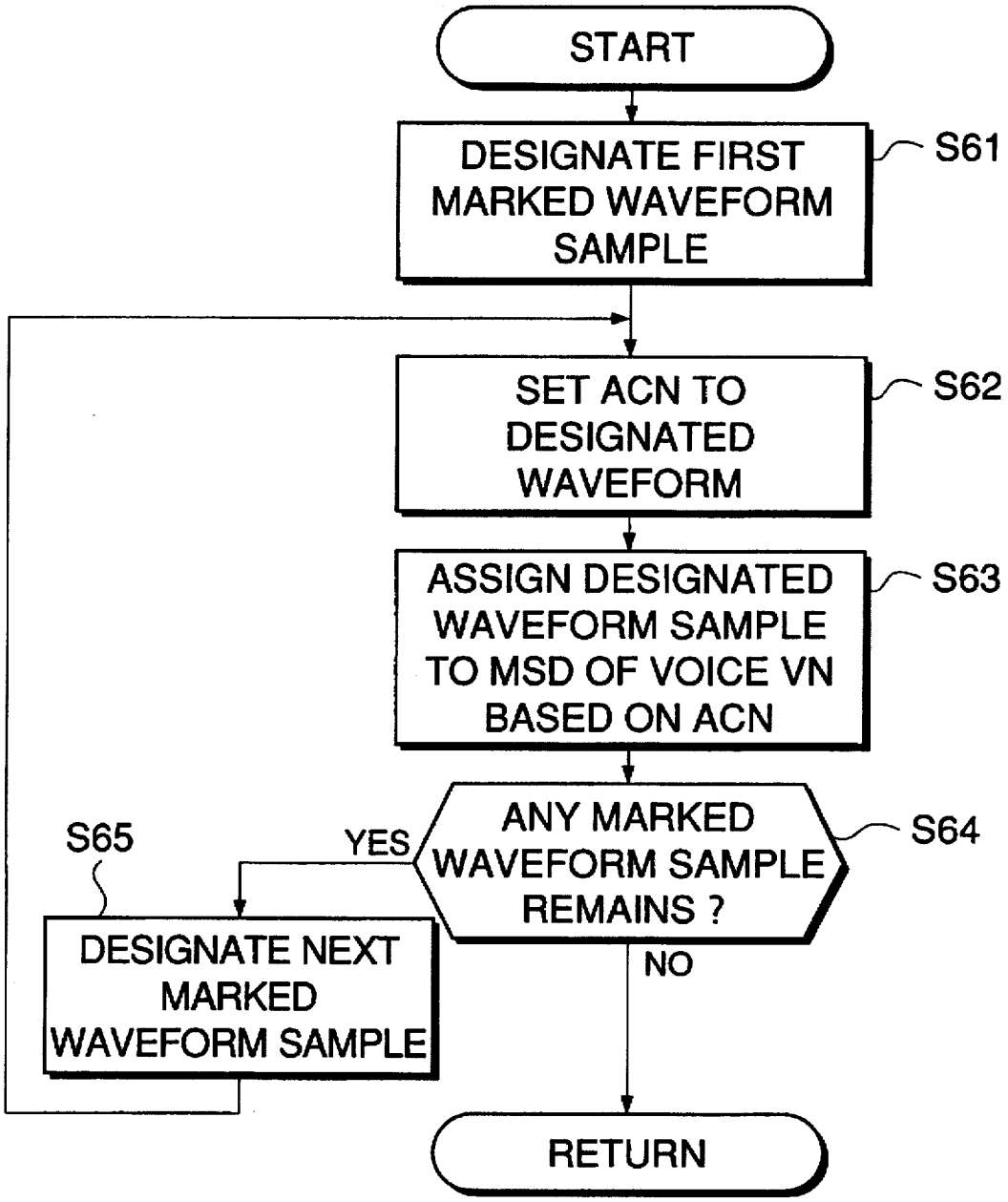
FIG. 10 is a flowchart showing details of a subroutine for a sequential automatic mapping processing.

FIG. 10 shows a subroutine for the sequential automatic mapping processing.

First, a first marked waveform sample is designated at a step S61, and an assign center note ACN is set for the designated waveform sample at a step S62 in a manner similar to that at the step S16 of the FIG. 5 subroutine. The designated waveform sample is newly assigned based on the assign center note ACN to the multi-sample data region MSD of the voice data designated by the voice VN at a step S63.

The following steps S64 and S65 are the same as the steps S43 and S44 of the FIG. 8 subroutine, and therefore description thereof is omitted.

Figure 11:
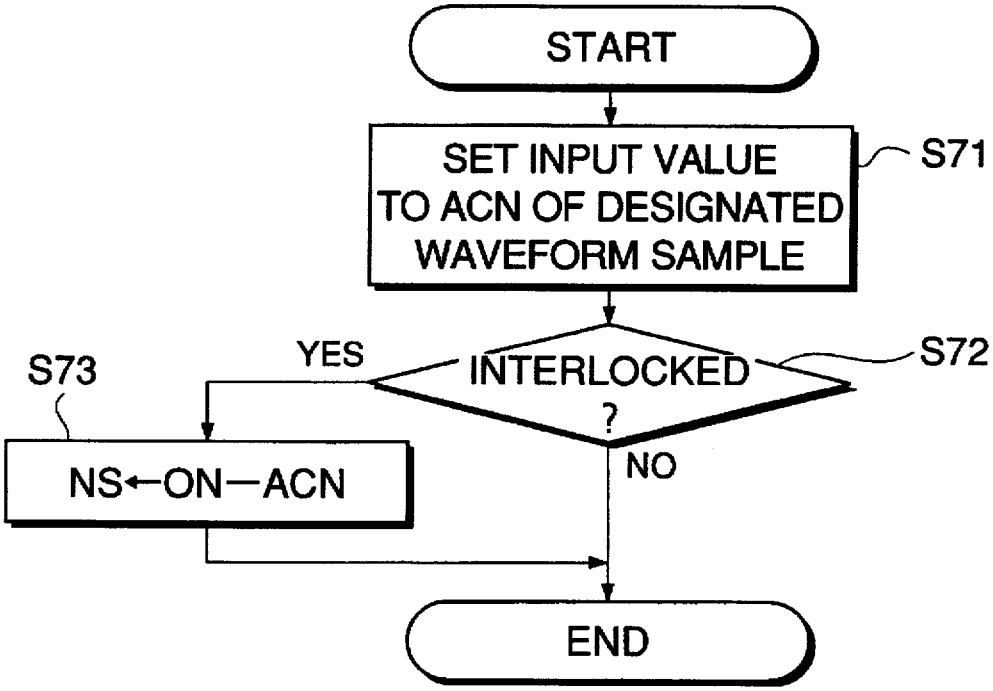
FIG. 11 is a flowchart showing a subroutine for an assign center note ACN-setting event processing.

FIG. 11 shows a subroutine for the assign center note (ACN)-setting event processing. This subroutine is called into execution when depression of an assign center note-setting switch, not shown, is detected during the ACN-setting processing e.g. at the step S33 in FIG. 7.

In the figure, an input value is written as the assign center note ACN of the designated waveform sample at a step S71. Then, it is determined at a step S72 whether or not an interlocking operation has been instructed by the note shift (NS)-interlocking switch $21_2$ appearing in FIG. 2, i.e. whether or not the value of the NS-interlocking flag is set to 1 in response to depression of the switch $21_2$. If the interlocking operation has been instructed, i.e. if the NS-interlocking flag is equal to 1, the value of the assign center note ACN written as above is subtracted from the value of the original note ON to store the resulting difference into a region NS within the RAM 5 allocated thereto at a step S73, followed by terminating the assign center note (ACN) -setting event processing. On the other hand, if the interlocking operation has not been instructed, i.e. if the NS-interlocking flag is equal to 0, the subroutine is immediately terminated.

Figure 12:
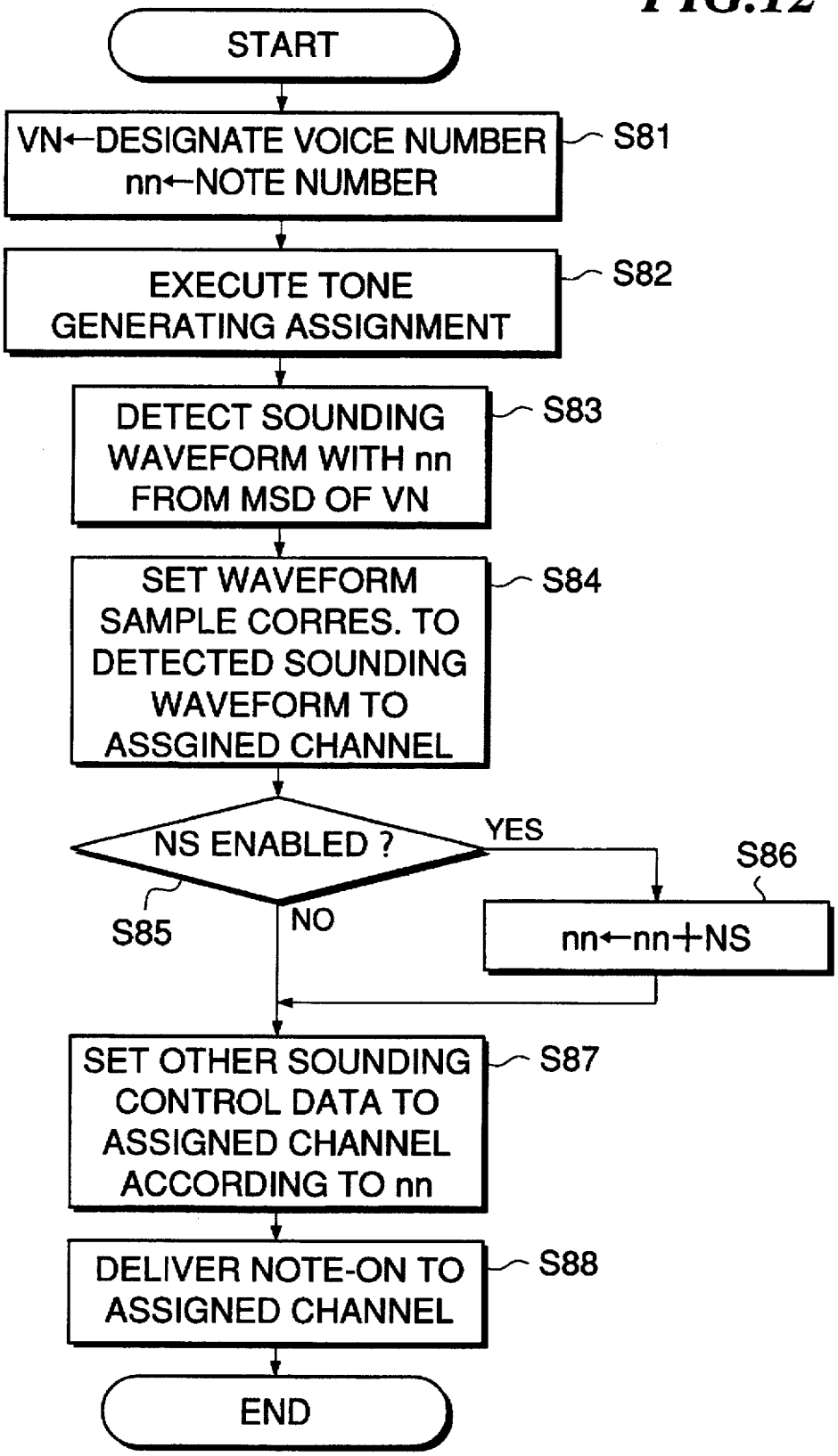
FIG. 12 is a flowchart showing a subroutine for a MIDI note-on signal-receiving event processing executed during a MIDI processing at a step S2 of the FIG. 4 main routine.

FIG. 12 shows a subroutine for a MIDI note-on signal-receiving event processing executed during the MIDI processing subroutine at the step 2 of the FIG. 4 main routine. This event processing is called into execution when a note-on code is received via the MIDI I/O 10 appearing in FIG. 1.

First, the received note-on code is analyzed to detect the note number, and data indicative of voice data designated by the note number is stored into the aforementioned region VN. The note number is also stored into a region nn within the RAM 5 allocated thereto (hereinafter the note number within the region nn will be referred to as "the note number nn") at a step S81. Assignment of a sounding channel for tone generation is carried out by the sound system 12, based on these data VN, nn at a step S82.

Then, a sounding waveform corresponding to a partial tone range containing the note number nn is detected from the multi-sample data region MSD of the voice data designated by the voice VN at a step S83, and data of the waveform sample corresponding to the sounding waveform detected at the step S83 is set to the sounding channel (ch) assigned at the step S82, thereby making it ready to read the waveform sample from the waveform RAM 11 via the waveform readout block 8 appearing in FIG. 1, at a step S84.

Then, it is determined at a step S85 whether or not the note shift (NS) has been enabled by depression of the note shift (NS)-enabling switch $21_3$, i.e. whether or not the NS-enabling flag has been set. If the note shift has been enabled, i.e. if the NS-enabling flag is equal to 1, the note number nn is updated by adding the amount of note shift NS thereto at a step S86, and then the program proceeds to a step S87. On the other hand, if it is determined at the step S85 that the note shift has not been enabled, i.e. if the NS-enabling flag is equal to 0, the program skips over the step S86 to the step S87.

At the step S87, other sounding control data corresponding to the note number nn within the voice data designated by the voice VN are set to the channel assigned for sounding, and at a step S88, a note-on signal is delivered to the sounding channel to give instructions for sounding, followed by terminating the present event processing.

Figure 13:
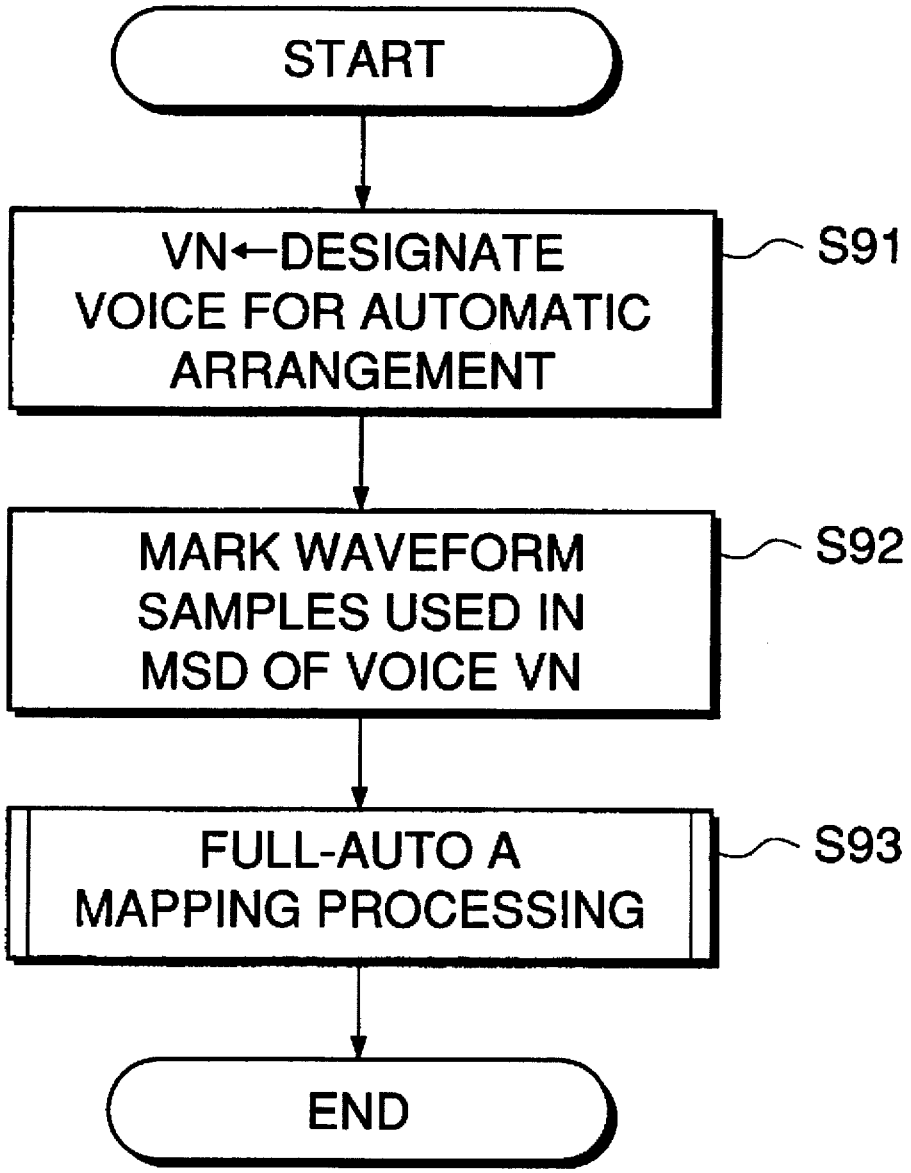
FIG. 13 is a flowchart showing a subroutine for an automatic arrangement event processing.

FIG. 13 shows a routine for the automatic arrangement event processing referred to hereinbefore. This event processing is called into execution when the automatic arrangement switch $21_4$ appearing in FIG. 2 is depressed.

First, at a step S91, a voice (tone color) desired for the automatic arrangement is designated and stored into the region VN at a step S91. By referring to the multi-sample data region MSD of the voice data designated by the voice VN, waveform samples assigned to the region MSD are marked at a step S92, and the FIG. 8 subroutine for the full-auto A mapping processing is called to execute the full-auto A mapping processing, followed by terminating the present processing.

As described heretofore, according to the present embodiment, waveform samples can be automatically mapped, whereby it is possible to reduce the labor and time of mapping, which has been required for each partial tone range, thereby enhancing the operatability of the electronic musical instrument.

What is claimed is:

1. An electronic musical instrument comprising:

a memory for storing data representative of a plurality of waveform samples;

a selector for selecting a predetermined number of waveform samples from said plurality of waveform samples stored in said memory;

a circuit for generating pitch information representative of a pitch within a predetermined tone range;

a circuit for instructing an automatic assignment of waveform samples in response to a user input;

a circuit for assigning responsive to said automatic assignment from said circuit for instructing, for setting a plurality of partial tone ranges equal in number to said predetermined number, within said predetermined tone range, and for assigning each of said waveform samples selected by said selector to a corresponding partial tone range; and a tone generator responsive to said pitch information from said pitch information generating circuit, for associating a partial tone range to said pitch information, for retrieving data representative of a waveform sample assigned to said associated partial tone range from said memory, and for generating a musical tone based on said data representative of the waveform sample retrieved from said memory.

2. An electronic musical instrument according to claim 1, including a circuit for designating a reference pitch for each of said predetermined number of said waveform samples, and wherein said circuit for assigning automatically sets each of said partial tone ranges based on one of said predetermined number of said designated reference pitches for said predetermined number of said waveform samples.

3. An electronic musical instrument according to claim 2, wherein said reference pitches are each inherently exhibited by a corresponding one of said predetermined number of said waveform samples when said corresponding one waveform sample is retrieved from said memory at a predetermined reference retrieval rate.

4. An electronic musical instrument according to claim 2, wherein said reference pitches are each set as desired as a pitch representative of a tone range to which a corresponding one of said predetermined number of waveform samples is desired to be assigned.

5. An electronic musical instrument according to claim 2, including a waveform sample-preparing circuit for preparing a new waveform sample, and for storing said new waveform sample into said memory, said selector being responsive to said preparation of said new waveform sample for selecting said new waveform sample in addition to said predetermined number of said waveform samples, said designating circuit designating a reference pitch for said new waveform sample, said circuit for assigning setting a partial tone range for said new waveform sample, based on said designated reference pitch in addition to said predetermined number of said partial tone ranges previously set, and for assigning said new waveform sample to said partial tone range set therefor.

6. An electronic musical instrument according to claim 2, wherein in assigning two waveform samples having respective reference pitches different from each other to two adjacent partial tone ranges within said predetermined tone range, said circuit for assigning automatically sets a pitch corresponding to a midpoint between said respective reference pitches of said two waveform samples as a border between said adjacent partial tone ranges to which said two waveform samples are assigned.

7. An electronic musical instrument according to claim 1, wherein said circuit for assigning automatically sets said predetermined number of said partial tone ranges within said predetermined tone range in a manner such that said predetermined tone range is partitioned into a predetermined number of pitch ranges, starting from a predetermined pitch within said predetermined tone range.

8. An electronic musical instrument according to claim 1, wherein said circuit for assigning automatically sets said predetermined number of said partial tone ranges within said predetermined tone range in a manner such that said predetermined tone range is equally divided by said predetermined number and the resulting divided tone ranges are set as partial tone ranges of said predetermined tone range.

9. A method of defining partial tone ranges within a predetermined tone range in an electronic musical instrument, the method comprising:

storing data representative of a plurality of waveform samples in a memory;

selecting a predetermined number of waveform samples from said plurality of waveform samples stored in said memory;

instructing an automatic assignment of waveform samples in response to a user input;

setting a plurality of partial tone ranges equal in number to said predetermined number within said predetermined tone range in response to said automatic assignment; and assigning each of said selected waveform samples to a corresponding partial tone range.

10. The method of claim 9, the method further including:

designating a reference pitch for each of said predetermined number of said waveform samples; and setting each of said partial tone ranges based on one of said predetermined number of said designated reference pitches for said predetermined number of said waveform samples.

11. The method according to claim 10, the method further including designating said reference pitches such that each reference pitch is inherently exhibited by a corresponding one of said predetermined number of said waveform samples when said corresponding one waveform sample is retrieved from said memory at a predetermined reference retrieval rate.

12. The method of claim 10, the method further including setting each reference pitch as a desired pitch representative of a tone range.

13. The method of claim 10, the method further including:

preparing a new waveform sample;

storing said new waveform sample into said memory;

selecting said new waveform sample in addition to said predetermined number of said waveform samples;

designating a reference pitch corresponding to said new waveform sample, setting a new partial tone range corresponding to said new waveform sample based on said designated reference pitch in addition to said predetermined number of said partial tone ranges previously set; and assigning said new waveform sample to said new partial tone range set therefor.

14. The method according to claim 9, the method further including assigning two waveform samples having respective reference pitches on a scale different from each other to two corresponding adjacent partial tone ranges within said predetermined tone range; and automatically setting a pitch corresponding to a midpoint on the scale between said respective reference pitches of said two waveform samples as a border between said adjacent partial tone ranges to which said two waveform samples are assigned.

15. The method according to claim 9, the method further including automatically setting said predetermined number of said partial tone ranges within said predetermined tone range in a manner such that said predetermined tone range is partitioned into a predetermined number of pitch ranges, starting from a predetermined pitch within said predetermined tone range.

16. The method according to claim 9, the method further including automatically setting said predetermined number of said partial tone ranges within said predetermined tone range in a manner such that said predetermined tone range is equally divided by said predetermined number and the resulting divided tone ranges are set as partial tone ranges of said predetermined tone range.

* * * * *